United States Patent [19]

Van Kanegan

[11] Patent Number: 4,628,815

[45] Date of Patent: Dec. 16, 1986

[54] REVERSIBLE LOCKUP SYSTEM FOR MAGNETICALLY SECURABLE PRINTING PLATES

[75] Inventor: Eugene M. Van Kanegan, Elmhurst, Ill.

[73] Assignee: Rockwell International Corporation, Pittsburgh, Pa.

[21] Appl. No.: 754,553

[22] Filed: Jul. 15, 1985

[51] Int. Cl.[4] ..... B41F 27/02; B41F 27/12

[52] U.S. Cl. ..... 101/415.1; 101/382 MV; 101/DIG. 12

[58] Field of Search .... 101/382 MV, 415.1, DIG. 12, 101/378

[56] References Cited

U.S. PATENT DOCUMENTS

| | | | |
|---|---|---|---|
| 2,621,592 | 12/1952 | Faeber | 101/DIG. 12 |
| 3,160,096 | 12/1964 | Norton | 101/415.1 X |
| 3,496,866 | 2/1970 | Nystrand | 101/378 |
| 3,670,646 | 6/1972 | Welch, Jr. | 402/503 X |
| 3,882,775 | 5/1975 | Lytle et al. | 101/382 MV X |

FOREIGN PATENT DOCUMENTS

| | | | |
|---|---|---|---|
| 1150830 | 5/1969 | United Kingdom | 101/DIG. 12 |
| 2083411 | 3/1982 | United Kingdom | 101/DIG. 12 |
| 2122546 | 1/1984 | United Kingdom | 101/415.1 |

*Primary Examiner*—Clifford D. Crowder

[57] ABSTRACT

An improved printing cylinder/plate lockup combination in which the plate cylinder has a groove running laterally across its width. A magnet contained in a magnetic insulator is secured to the cylinder within the groove. The magnetic insert contains four register pins in a configuration which provides for plate cylinder reversibility while fitting into a small arc of the cylinder's surface. The magnetically securable plate is prepared with a variety of openings adjacent the trailing and leading ends of the plate which secure the plate in predetermined registry without the need for critical manufacturing tolerances.

2 Claims, 3 Drawing Figures

REVERSIBLE LOCKUP SYSETM FOR MAGNETICALLY SECURABLE PRINTING PLATES

BACKGROUND OF THE INVENTION

This invention relates to means for securing printing plates to the plate cylinders of rotary printing presses. Such means are generally referred to as plate lockups. The invention, more specifically, is directed to the field where printing plates are held to their cylinders by magnetic force from permanent magnets and where the plates are accurately positioned on the cylinder thru use of register pins.

DESCRIPTION OF THE PRIOR ART

U.S. Pat. No. 3,496,866 to Nystrand teaches a construction for providing a permanent magnet cylinder insert to hold down the leading and trailing edges of a thin magnetically attractable plate (i.e. a steel based plae) onto a plate cylinder.

The relative smallness of the arc of the cylinder circumference taken up by such a lockup insert is mandatory in printing applications where only a small arc is available. An example of this condition is in newspaper printing where the maximum allowable non-print gap between successive images is typically one inch. If, as in the case of flexography being developed for newspapers, a relatively thick (0.030" or more) compressible cushion is required under all printing areas of the plate, then the arc of the cylinder circumference available for the lockup is also very limited, typically to one inch or less. In this and other applications, use of a relatively small arc insert is an advantage in reducing manufacturing complexity and costs.

Other patents such as U.S. Pat. No. 3,824,927 to Pugh, et al., teach the use of alignment pins to accurately register the plates on their cylinder. In the best embodiments, such pins are substantially enclosed or surrounded by the plate material. This is advantageous to prevent unwanted movement of the plate on the cylinder due to impact forces working on the plate from impression to paper (in the cases of flexography, letterpress printing, direct lithography), or blanket cylinder (in the case of litho offset) and the impact forces from plate contact with the press' inking rollers. It can be noted that Pugh, et al., use a relatively large flat flexible magnetic member and as such do not have the advantages of a small arc insert mentioned before in reference to Nystrand.

U.S. Pat. No. 3,882,775 to Lytle, et al., teaches use of two register pins for locating the plate on a magnetic cylinder. It provides for register of plates which are closely spaced as is required in printing applications such as newspaper. The trailing edge of one plate is close to the leading edge of the next. To accomplish this, open ended plate notches are used. The register system provides for preventing axial movement of trailing end of the plate by side guiding on the same pins which are used for the leading end register. The lockup is also reversible, meaning that the plate cylinder can be rotated in either direction. This reversibility is also often required in printing applications such as newspaper.

The problem that remains is that of providing a reversible magnetic lockup with register means, which fits into the small arc available in some printing applications. The Lytle invention uses a large area of the cylinder surface to magnetically hold the plate from unwanted movement. Experience with even the best of the magnetic inserts which fit into small arcs of one inch is that, while the magnetic force is adequate to prevent centrifugal throwing of the plate at surface speeds as high as 2,300 feet per minute with 15 inch diameter cylinders, the force is not adequate to prevent plate movement. The register pins at the leading end must be surrounded by the plate to insure no unwanted movement. The Lytle invention cannot provide this feature when close spacing of leading and trailing edges are required.

Even if the desirable axial register of the trailing end is forfeited so that the pins can be surrounded by the leading edge of the plate, a problem remains. To be reversible, a narrow arc lockup would have the two lockup pins symmetrically located in the center of the lockup arc. That, however, provides a considerably larger amount of precious lockup arc for the leading edge than for the trailing edge, resulting in weak inadequate hold down of this trailing edge.

Another shortcoming of the present art arises when the height of the register pins over the lockup is severely limited. Such is the case in application to lithography where the pin should protrude no higher than the plate surface to prevent damage of interacting rollers and printing blankets. That limits pin height over the lockup to the thickness of the litho plate which is typically 0.006 to 0.014 inches. Again, in application to shallow relief flexo and letterpress printing where the plate's relief depth is typically 0.015 inches and impression interferences may be 0.008 inches, the pin height should not protrude more than a few thousands of an inch above the plate's base steel which is typically 0.007 inches thick. With this pin height restriction of 0.006 to 0.014 inches, it is very difficult to load plates onto the lockups and be sure the pins are adequately engaged.

SUMMARY OF THE INVENTION

The present invention is concerned with an improved plate cylinder and plate combination in which an elongated magnetic body is secured in a slotted plate cylinder within a magnetic flux insulator. The magnet has four register pins that extend outwardly toward the surface of the plate cylinder. The plate, which is composed of a magnetically attractible material, has openings adjacent its the trailing and leading edges which have a definite preselected relationship with respect to the register pins whereby accurate placement of a plate on the plate cylinder can be achieved with minimum manufacturing problems.

Accordingly, it is an object of this invention to provide a lockup including accurate register means for magnetically securable printing plates which is reversible, fits in a small arc of the plate cylinder, allows for plates which are closely spaced between leading and trailing edges, and provides an improved distribution of arc length used for hold down of leading edge versus trailing edge of the plate.

Another object of this invention is to provide means for preventing axial movement of the trailing end of the plate where such small arc lockups are required.

Another object of this invention is to provide means for improving the ease of plate mounting with better assurance that register pins are adequately engaged.

Still other objects and advantages such as simplicity and low cost will become apparent upon reading the attached detailed description and reference to the drawings.

DESCRIPTION OF THE PREFERRED EMBODIMENT

Figure 1:
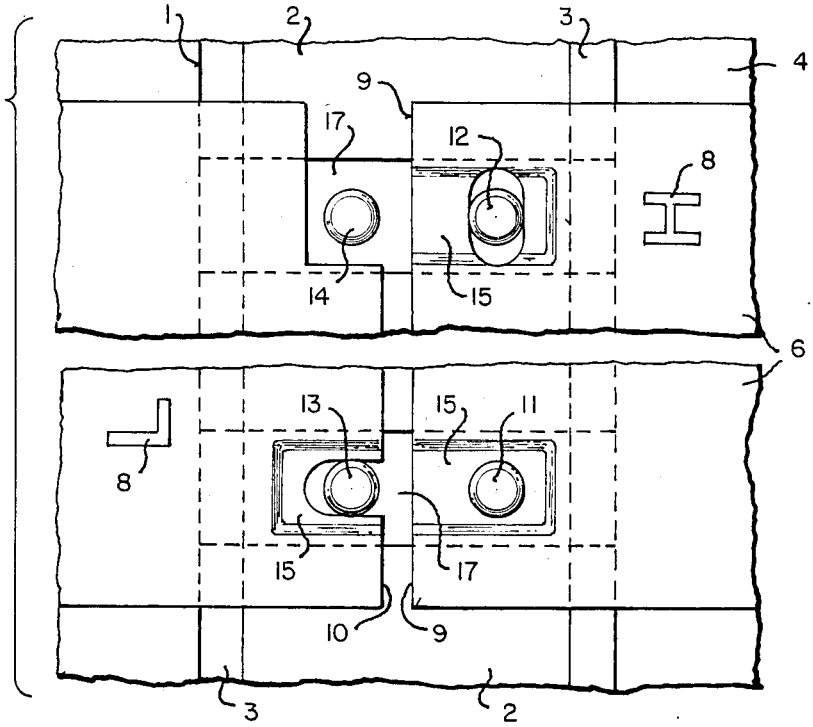
FIG. 1 is a top plan view of a printing plate mounted on the magnetic lockup insert containing four register pins as is taught in this invention.
Figure 2:
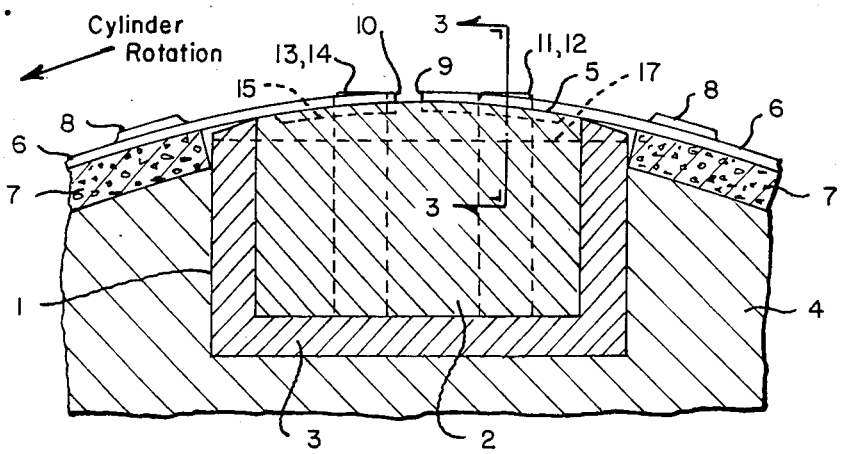
FIG. 2 is an end view, again showing the lockup insert with a printing plate in place.

An embodiment which provides a magnetic lockup for reversible printing cylinders is seen in FIG. 1 and FIG. 2 where reference numeral 1 indicates a lockup insert which includes an assembly of permanent magnets 2 contained in a flux insulating channel 3, all being mounted into and attached to plate cylinder 4. The curved surface 5 (see FIG. 2) of the magnetic insert is at essentially the same radius from the center of the plate cylinder as the bottom surface of the steel based printing plate 6 is in areas where printing occurs.

The embodiment shown in FIG. 2 shows the application of the invention to flexographic printing being developed for newspapers where plate 6 must be resiliently supported on a compressible cushion 7 in all printing areas of the plate. Such raised printing areas are schematically represented by numeral 8 in the figures. In the situation where a cushion is used under the plate, the radius of the curved surface of the magnetic insert is made to be 0.002" to 0.010" below the nominal bottom surface of the plate's steel base to provide better alignment with the plate during impression and eventual beat-down of the cushion.

To minimize the arc of non-printing areas, the arc taken up by the lockup must be minimized. It has been discovered that maximum efficiency in use of the arc can be achieved thru use of the four register pin configuration shown in FIG. 1. This four-pin configuration enables several things to be accomplished.

First, the area near leading edge 9 of the plate can be punched so that it surrounds a pair of register pins, 11 and 12, to provide an accurate and shift free location of the leading end of the plate. Pin 11 is closely surrounded by the plate all around to provide register for that corner of the plate in both the across-cylinder, lateral or axial direction and in the around-cylinder or circumferential direction. The elongated or slotted plate punch at pin 12 completes the register near the leading edge of the plate by preventing circumferential shifting of it's corner while at the same time allowing for inaccuracies in the spacing of pins 11 and 12.

Secondly, the off-center location of the lead edge pins 11 and 12 in the lockup insert provides for an improved distribution of arc length used for hold down of plate material near the leading edge 9 versus that near the trailing edge 10. In this embodiment, the arc of the magnetic insert used in hold down of the leading edge is made slightly longer than that for the trailing edge although an equal distribution is also possible. In either case, the trailing edge 10 can be made to be closely spaced (typically within 0.06") to the leading edge 9.

Thirdly, register pin 13 at the trailing edge of the plate can be close fitting at it's side (axially) in an elongated plate punch as shown in FIG. 1 so that across-cylinder lateral shifting of the trailing end is prevented, at the same time allowing for slight around-cylinder motion of the trailing end of the plate during printing. An oversize plate punch is provided at pin 14 which is inactive with the direction of plate cylinder rotation indicated at FIG. 2.

Finally, the symmetry of the four-pin configuration provides for reversibility of rotation of the plate cylinder. When the cylinder rotation is reversed from that indicated at FIG. 2, the same plate punch configuration is used but the plate is mounted to the cylinder with the round lead edge punch over pin 14, the oblong lead edge punch over pin 13, and the close fitting elongated trailing edge punch at pin 12. Thus, the functions of pins 11 and 14 are interchanged and the functions of pins 12 and 13 are interchanged when running reversed.

In application to lithography, the pins should protrude no higher than the plate surface to prevent damage of interacting rollers and printing blankets. That limits pin height over the lockup to the thickness of the litho plate which is typically 0.006 inch to 0.014 inch. Similarly, in application to shallow relief flexo and letterpress printing, where the plates relief depth is typically 0.015 inch and impression interferences may be 0.008 inch, the pin height should not protrude more than a few thousandths of an inch above the plates base steel which is typically 0.007 inch thick.

Figure 3:
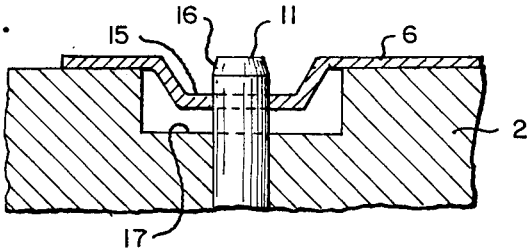
FIG. 3 is an enlarged sectional view showing a typical depression of the plate in the area of a register pin as is taught in this invention. The view corresponds to the section arrows 3—3 of FIG. 2.

This embodiment includes the use of depressions in the plate's steel base at the three active register pin positions. An enlarged view of a depression is shown in FIG. 3 where the steel base 6 has been pressed downward (area noted as 15) prior to punching the plate for it's close fit with the register pin (11 in this figure). The depth of depression is typically 0.030". This increases the depth of engagement over the register pins and thus assures adequate engagement. At the same time, this increased depth of engagement allows the addition of a chamfer (16) to the register pins which greatly improves the ease of locating the plate over the register pins. Slots (noted as 17 in the figures) are machined into the lockup insert to provide clearance around the depressions.

In some printing applications, double-wide plates can be used which cover the width of two laterally adjacent magnetic inserts with the center two pin positions at the leading edge being surrounded by an oversize plate punch or an elongated hole (similar to that at pin 12 in FIG. 1) and the center two pin positions at the trailing edge having an oversize plate punch.

Other variations, within the scope of the claims, will be apparent to those skilled in the art, in light of the foregoing description and accompanying drawings. Thus, while in the preferred embodiment, a curved surface 5 is described for the magnetic insert, a flat surface might also be used. Other forms of depressions 15 in the plate's steel base at the active register in positions might be used also. The invention can be applied to printing cylinders where only a single plate wraps the entire circumference or where two or more plates follow each other around the cylinder's circumference. These variations are merely illustrative.

Having thus described the invention, what is claimed is:

1. In a printing cylinder for use with thin magnetically attractable printing plates, the combination comprising:

(a) a plate cylinder having a transverse slot formed across the width of said cylinder;

(b) a liner mounted in the transverse slot of said plate cylinder, said liner being insulating with respect to magnetic fields;

(c) a magnetic insert occupying not more than one inch of the arc of said plate cylinder circumference disposed within said liner across the width of said plate cylinder;

(d) at least two pairs of register pins mounted in and extending outwardly from said magnetic insert to provide register locations for a printing plate on said plate cylinder having;

(1) a first pair of said pins spaced laterally in the across-cylinder direction and used to provide register location of the leading end of a plate by said plate surrounding said first pair of pins;

(2) a second pair of said pins spaced laterally identically to said first pair but also spaced circumferentially from said first pair, said second pair of pins being used instead of said first pair of pins to provide register location of the leading edge of a plate by said plate surrounding said second pair of pins when plate cylinder rotation is reversed from the rotation associated with use of said first pair of pins; and (e) a thin magnetically attractable non-extensible printing plate having:

(1) formed adjacent the leading edge thereof, (i) a circular opening sized to closely receive one of said register pins;

(ii) a slotted opening sized to closely receive a separate register pin in the circumferential direction and to be free fitting in the lateral direction of said plate, and (2) formed adjacent the trailing edge thereof (i) a slotted opening having a width in the lateral direction of said plate which closely fits with one of said register pins; and (ii) an open portion that is oversized in all directions with respect to its associated pin.

2. The combination as defined in claim 1 wherein the surface of said magnetic insert is substantially contained in a cylindrical plane that would contain the inner base surface of said printing plate.

* * * * *